US011774162B2

(12) United States Patent
Toal

(10) Patent No.: US 11,774,162 B2
(45) Date of Patent: Oct. 3, 2023

(54) DRAIN PAN UTILIZING OPEN FRONT AND TRENCH

(71) Applicant: Short Run Pro, Belmont, NC (US)

(72) Inventor: Scott Toal, Charlotte, NC (US)

(73) Assignee: Short Run Pro, Belmont, NC (US)

( * ) Notice: Subject to any disclaimer, the term of this patent is extended or adjusted under 35 U.S.C. 154(b) by 720 days.

(21) Appl. No.: 16/988,612

(22) Filed: Aug. 8, 2020

(65) Prior Publication Data

US 2021/0055036 A1 Feb. 25, 2021

Related U.S. Application Data

(60) Provisional application No. 62/888,579, filed on Aug. 19, 2019.

(51) Int. Cl.

| | |
|---|---|
| ***F25D 21/14*** | (2006.01) |
| ***F24H 9/17*** | (2022.01) |
| *F24F 13/22* | (2006.01) |

(52) U.S. Cl.

CPC ..... *F25D 21/14* (2013.01); *F24H 9/17* (2022.01); *F24F 13/222* (2013.01); *F25D 2321/143* (2013.01); *F25D 2321/1442* (2013.01)

(58) Field of Classification Search

CPC ..... F25D 21/14; F24H 9/17

See application file for complete search history.

(56) References Cited

U.S. PATENT DOCUMENTS

| | | | | |
|---|---|---|---|---|
| 4,513,586 | A * | 4/1985 | Jennings | F24F 1/36 62/297 |
| 4,783,971 | A * | 11/1988 | Alba | F25D 21/14 312/334.44 |
| 5,099,873 | A * | 3/1992 | Sanchez | F24F 5/0035 340/625 |
| 5,452,739 | A * | 9/1995 | Mustee | A47L 15/4212 4/251.1 |
| 5,645,103 | A * | 7/1997 | Whittaker | F24H 9/17 220/571 |
| 5,787,721 | A * | 8/1998 | Fromm | F25D 21/14 62/272 |
| 9,671,127 | B2 * | 6/2017 | Mercer | F24F 1/0323 |
| 9,874,374 | B1 * | 1/2018 | Gill | F24H 9/17 |
| 10,309,683 | B2 * | 6/2019 | Choi | F24F 1/0022 |
| 2005/0109055 | A1 * | 5/2005 | Goetzinger | F24F 13/222 62/291 |
| 2008/0134705 | A1 * | 6/2008 | Cushen | F24F 13/222 29/428 |

(Continued)

*Primary Examiner* — Kevin R Barss

(74) *Attorney, Agent, or Firm* — Jeffrey C. Watson, Esq.

(57) ABSTRACT

A drain pan utilizing an open front and a trench includes a bottom pan member, the trench, a drain hole, and a trench cover. The bottom pan member includes the open front. The trench is positioned below the bottom pan member adjacent the open front of the bottom pan member of the drain pan. The trench is configured to capture fluid flowing onto the bottom pan member of the drain pan and before the fluid flows out of the open front. The drain hole is in communication with the trench. The drain hole is configured to evacuate any fluid from the bottom pan member that flows into the trench. The trench cover is configured for providing a flat trench surface over the trench. The trench cover includes perforations to allow fluid to flow into the trench from the bottom pan member of the drain pan.

20 Claims, 8 Drawing Sheets

(56) References Cited

U.S. PATENT DOCUMENTS

| | | | | |
|---|---|---|---|---|
| 2008/0245802 | A1* | 10/2008 | Gray | F24F 13/222 220/571 |
| 2009/0064699 | A1* | 3/2009 | Miller | F24F 13/222 62/77 |
| 2010/0018980 | A1* | 1/2010 | Oakner | F24F 13/22 220/571 |
| 2010/0175408 | A1* | 7/2010 | Korda | F16N 31/002 413/1 |
| 2011/0011114 | A1* | 1/2011 | Higa | B60H 1/3233 62/291 |
| 2012/0000231 | A1* | 1/2012 | LaFontaine | F25D 21/14 220/571 |
| 2012/0159981 | A1* | 6/2012 | Beck | F24F 13/222 220/571 |
| 2013/0318704 | A1* | 12/2013 | Plank | E03F 5/0408 29/428 |
| 2015/0153094 | A1* | 6/2015 | Mercer | F24F 13/222 62/291 |
| 2018/0202704 | A1* | 7/2018 | Long | F25D 21/14 |

* cited by examiner

DRAIN PAN UTILIZING OPEN FRONT AND TRENCH

CROSS-REFERENCE TO RELATED APPLICATIONS

This application claims the priority benefit of U.S. Provisional Application No. 62/888,579, filed on Aug. 18, 2019, entitled "Drain Pan Utilizing Open Front and Trench", which is incorporated by reference herein in its entirety.

FIELD OF THE DISCLOSURE

The present disclosure relates to a drain pan for an appliance, like a washing machine, or the like. More particularly, the present disclosure is directed to a drain pan utilizing an open front and a trench.

BACKGROUND

Generally speaking, a drain pan is a device which is positioned under an appliance, like a washing machine, refrigerator, air conditioner, dishwasher, hot water heater, icemaker, the like, etc., to provide some measure of protection against a leak which might develop, or against accidental spills. Typically the drain pan catches water overflow from your appliance or possibly leakage from a faulty water hose, and it even provides a measure of protection for your floor against condensation. Drain pans can be especially critical if your appliance is located on the second or third floor of your home, because any water leakage above the first floor can have even more serious consequences when water leaks through.

A drain pan is usually shaped as a rectangle which is sized slightly larger than your appliance, and it can be purchased at most hardware and plumbing stores. To install, a user usually must remove the appliance or install the drain pan prior to installing the appliance, install the drain pan, and then lift the appliance onto the drain pan to get the drain pan placed underneath, and it then has to be connected to a drain pipe, so as to funnel away excess water. Most drain pans come with a pre-cut hole which you can fit a PVC pipe into, while placing the other end of the pipe in the drain itself. In this setup, even with a major leakage, water will never rise above the level of the drain pan itself, because it will always be channeled away into the drainage system.

The instant disclosure recognizes the problem and difficulty of lifting the appliance and setting it onto the drain pan, as large appliances like washing machines, refrigerators, or the like can be very heavy and cumbersome to lift. As such, there is clearly a need to provide an easier means for installing a drain pan under an appliance.

The instant disclosure also recognizes that the appearance of the drain pan under the appliance is not appealing to most owners, as the front lip is required in front of the appliance to keep the water from spilling out in front of the appliance, which is very visible as it is in front of the appliance. As such, there is clearly a need to provide a more aesthetically appealing drain pan for an appliance.

The instant disclosure may be designed to address at least certain aspects of the problems or needs discussed above by providing a drain pan utilizing an open front and a trench.

SUMMARY

The present disclosure solves the aforementioned limitations of the currently available drain pans, by providing a drain pan utilizing an open front and a trench. The drain pan utilizing the open front and the trench may include a bottom pan member, the trench, a drain hole, and a trench cover. The bottom pan member may include the open front. The trench may be positioned below the bottom pan member adjacent the open front of the bottom pan member of the drain pan. The trench may be configured to capture fluid flowing onto the bottom pan member of the drain pan before the fluid flows out of the open front. The drain hole may be in fluid communication with the trench. The drain hole may be configured to evacuate any fluid from the bottom pan member that flows into the trench. The trench cover may be configured for providing a flat trench surface over the trench. The trench cover may include perforations to allow fluid to flow into the trench from the bottom pan member of the drain pan.

In select embodiments of the disclosed drain pan, the bottom pan member may include sidewalls around the bottom pan member everywhere except the open front. These sidewalls positioned around the bottom pan member everywhere except the open front may be configured to provide a barrier to fluids from escaping the bottom pan member of the drain pan, whereby the sidewalls direct the fluid to the trench via gravity. In select embodiments, the sidewalls of the bottom pan member may include a left sidewall on a left side of the bottom pan member, a back sidewall on a back of the bottom pan member, and a right sidewall on a right side of the bottom pan member. The sidewalls may be connected and sealed together at corner joints and to the bottom pan member via a connecting method, including, but not limited to, integral forming, welding, adhesives, the like, or any other various means or method for connecting and sealing the sidewalls.

One feature of the disclosed drain pan may be that the bottom pan member may include a shape and configuration configured to fit under and hold a piece of equipment. In select embodiments, the bottom pan member may include a shape and configuration configured to fit under an appliance including, but not limited to, a washing machine, a refrigerator, an air conditioner, a dishwasher, a hot water heater, an icemaker, the like, or other various pieces of residential, commercial, or industrial equipment or appliances. In select embodiments, the shape of the bottom pan member may be a rectangular shape or a square shape.

Another feature of the disclosed drain pan may be that the sidewalls may have ends that extend beyond the trench and taper at said ends that extend beyond the trench approximate the open front of the bottom pan member. These tapers may be configured for safety and aesthetic appearance.

Another feature of the disclosed drain pan may be that the bottom pan member may have a smooth flat top. The smooth flat top of the bottom pan member may be configured to allow fluid to flow undisturbed on top of and across the bottom pan member into the trench at the open front of the bottom pan member.

Another feature of the disclosed drain pan may be that the trench cover may be configured to hide the trench from view and allow fluid to empty into the trench, wherein the trench cover may be configured as a decorative cover.

Another feature of the disclosed drain pan may be that drain fittings can be included that are configured to connect the drain hole in the bottom of the trench to an existing drain piping system.

In select embodiments of the disclosed drain pan, the bottom pan member may be configured to be installed at a floor level or below the floor level. As a result, the trench may be configured to be positioned below the bottom pan member.

In select embodiments of the disclosed drain pan, the trench may be connected to the open front of the bottom pan member by a connection means including, but not limited to, being integrally formed, welded, overlapping, sealed to the open front of the bottom pan member, the like, or any other various means for connecting the trench to the open front of the bottom pan member.

Another feature of the disclosed drain pan may be that the bottom pan member may include a smoothed front lip. The smoothed front lip may be configured for safety and to provide support at a floor level for the trench at the open front of the bottom pan member.

In select embodiments of the disclosed drain pan, the bottom pan member may be made from a material including, but not limited to, metals, plastics, rubber, the like, and/or combinations thereof.

In select embodiments of the disclosed drain pan, the trench may be, but does not have to be, made of a different material from the bottom pan member. As exampled, and clearly not limited thereto, the trench may be made from metals, plastics, rubbers, the like, and/or combinations thereof.

Another feature of the disclosed drain pan may be that it can be configured to be used with all types of residential appliances or industrial equipment for preventing spills and damage from leaking fluids while being easy to load. Whereby, the open front and use of the trench is configured to allow for loading of the residential appliances or the industrial equipment in the drain pan without obstruction from sidewalls and the functionality to capture leaking fluids, divert the fluids to drain piping and evacuate the leaking fluid without damage to surrounding building materials.

In another aspect, the instant disclosure embraces the drain pan utilizing the open front and the trench in any of the various embodiments and/or combinations of embodiments shown and/or described herein.

In another aspect, the instant disclosure embraces a method of installing a drain pan under an appliance. The disclosed method of installing a drain pan under an appliance generally includes utilizing the drain pan utilizing the open front and the trench in any of the various embodiments and/or combinations of embodiments shown and/or described herein. As such, the method of installing a drain pan under an appliance may generally include providing the drain pan utilizing the open front and the trench in any of the various embodiments and/or combinations of embodiments shown and/or described herein. With the drain pan utilizing the open front and the trench installed, the method may further include positioning the appliance on top of the bottom pan member of the drain pan by rolling or sliding the appliance through the open front of the bottom pan member on top of the trench cover into position on the bottom pan member.

In select embodiments, the method of installing a drain pan under an appliance may further include connecting the drain hole in the trench to an existing drain piping system via drain fittings.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

Figure 1:
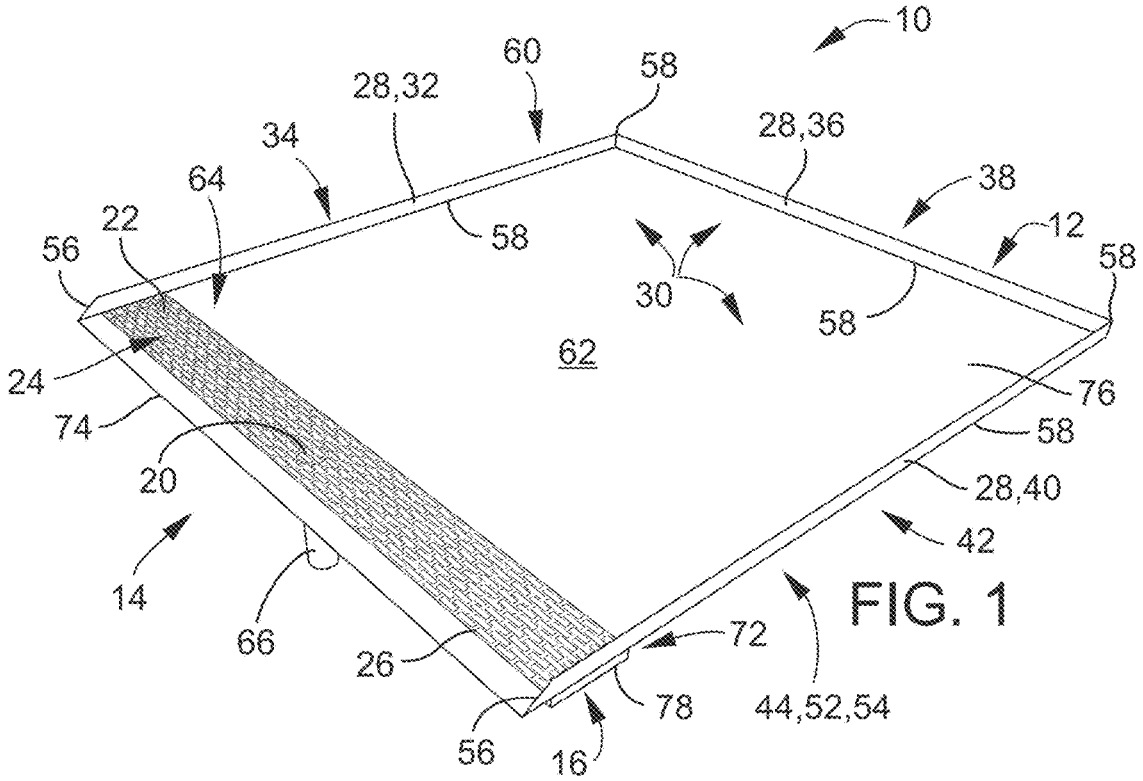
FIG. 1 is a front perspective view of the disclosed drain pan utilizing an open front and a trench according to select embodiments of the instant disclosure.
Figure 2:
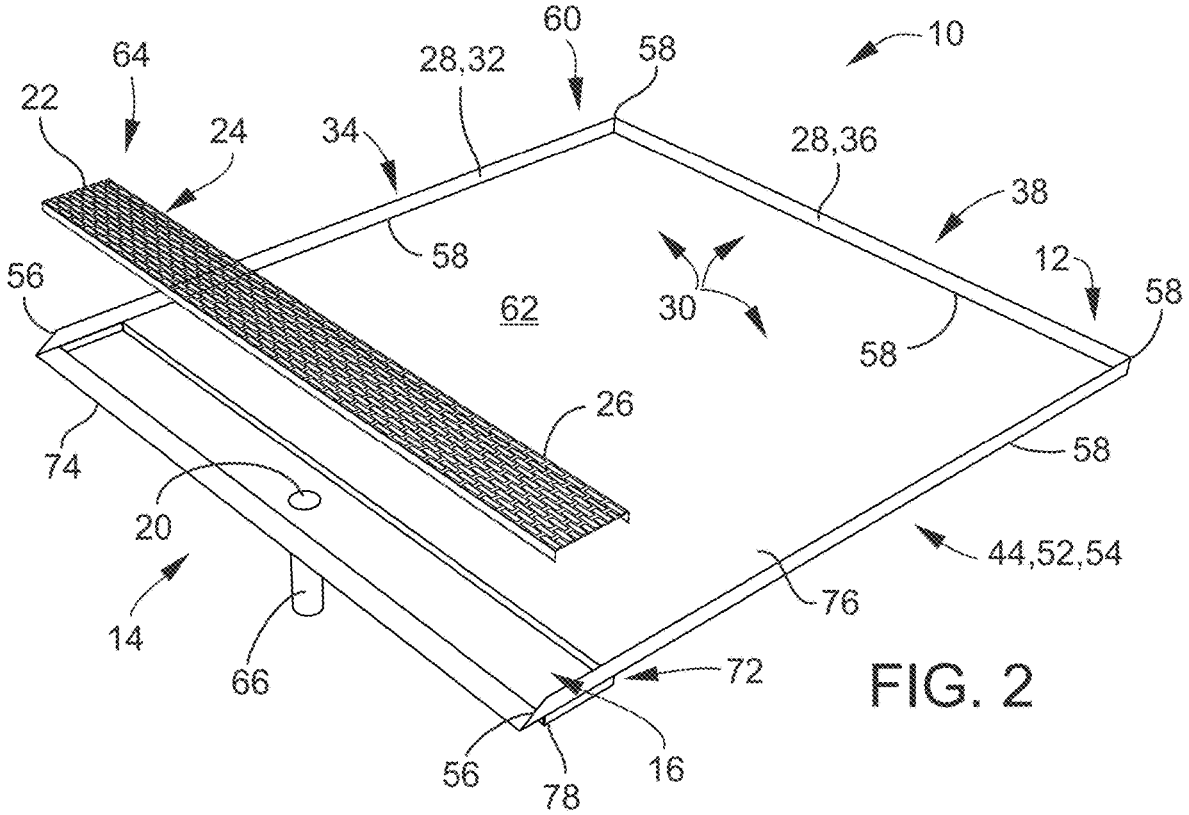
FIG. 2 is front top perspective partially disassembled view of the drain pan utilizing an open front and a trench of FIG. 1 with the trench cover removed.
Figure 3:
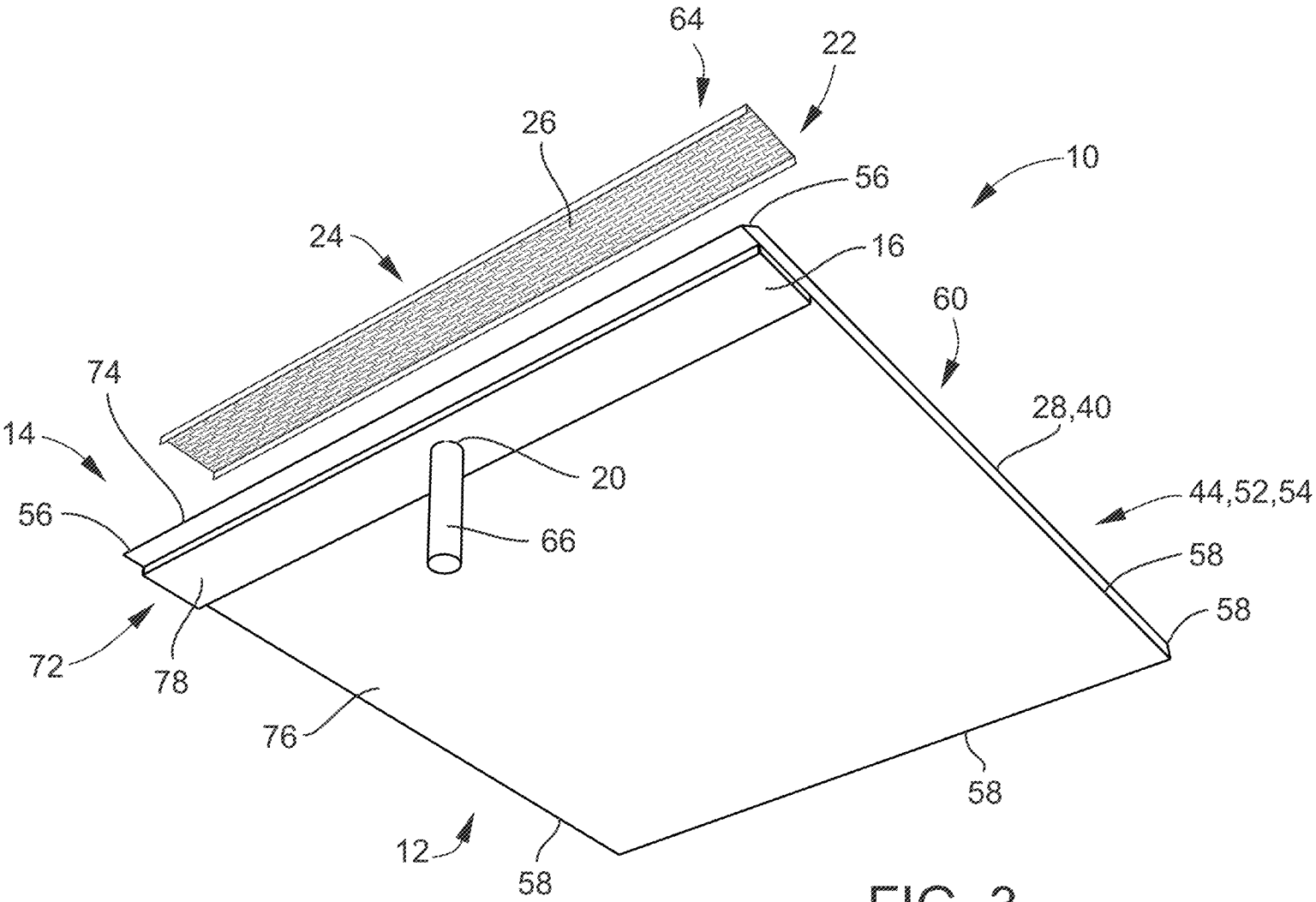
FIG. 3 is a front bottom perspective partially disassembled view of the drain pan utilizing an open front and a trench of FIG. 1 with the trench cover removed.
Figure 4A:
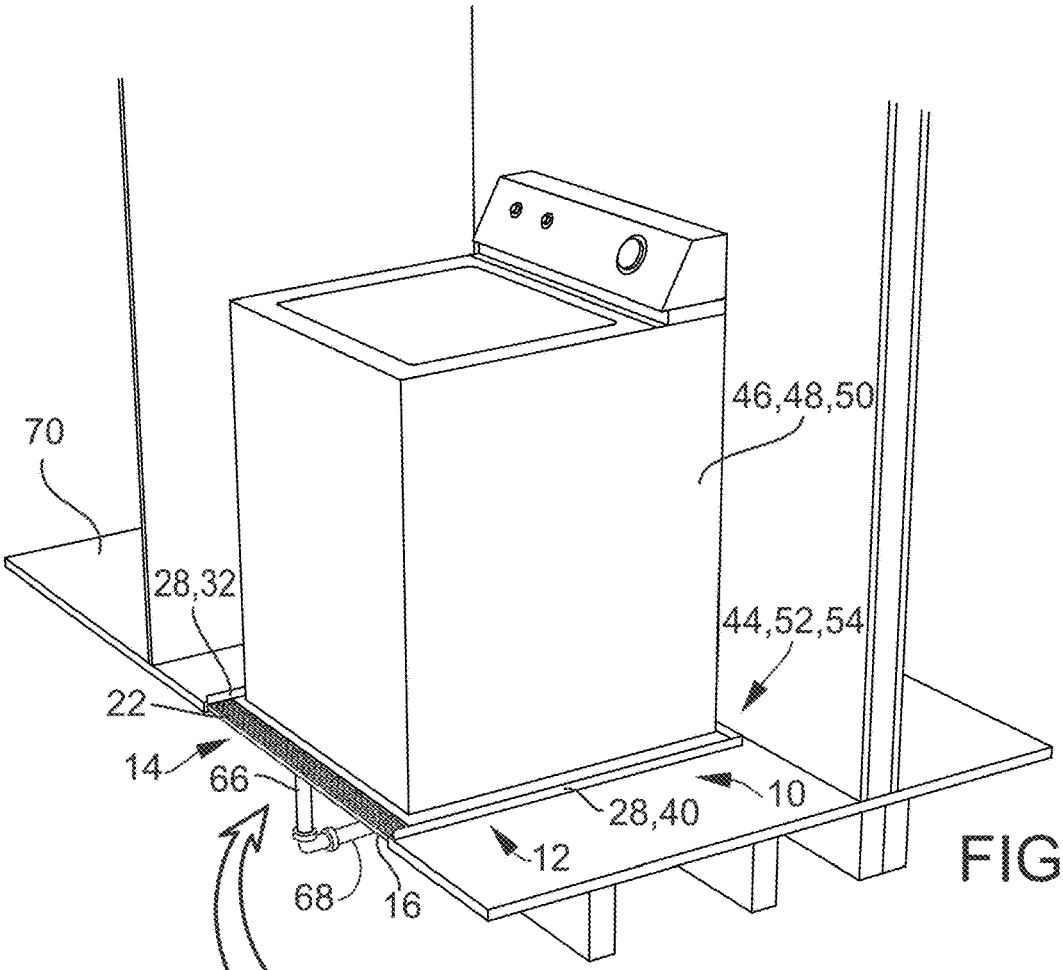
FIG. 4A is a front perspective environmental view of the disclosed drain pan utilizing an open front and a trench according to select embodiments of the instant disclosure installed beneath a washing machine.
Figure 4B:
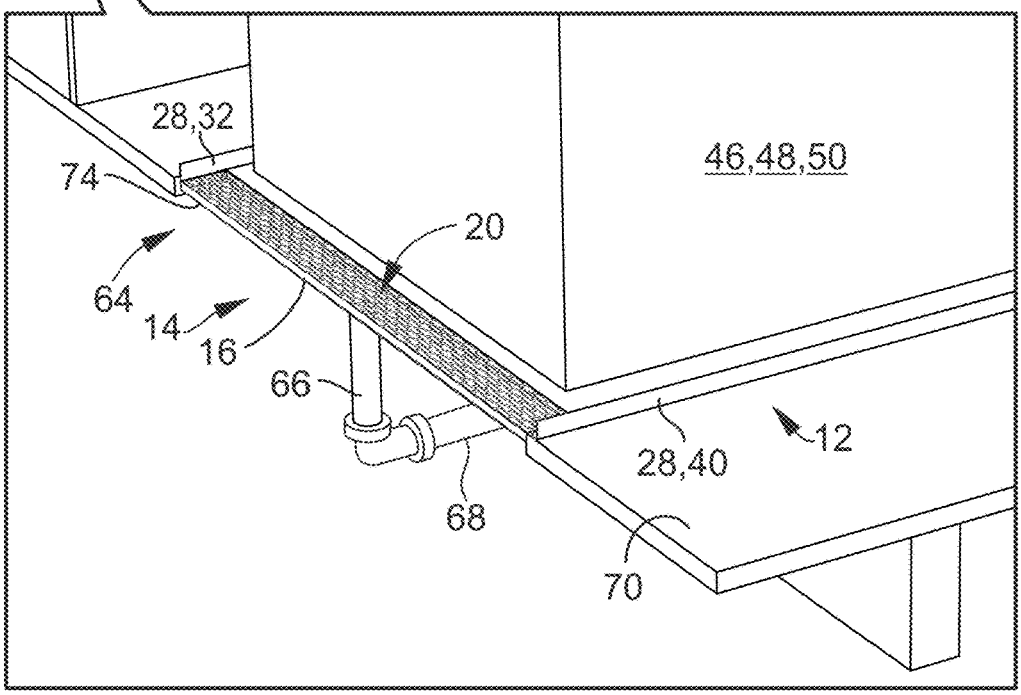
FIG. 4B is a zoomed in front perspective environmental view of the disclosed drain pan utilizing an open front and a trench of FIG. 4A.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-6, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

Referring now to FIGS. 1-5D, the present disclosure solves the aforementioned limitations of the currently available drain pans, by providing drain pan 10 utilizing open front 14 and trench 16. Drain pan 10 utilizing open front 14 and trench 16 may generally include bottom pan member 12, trench 16, drain hole 20, and trench cover 22. Bottom pan member 12 may include open front 14. Trench 16 may be positioned below bottom pan member 12 adjacent or in open front 14 of bottom pan member 12 of drain pan 10. Trench 16 may be configured to capture fluid flowing onto bottom pan member 12 of drain pan 10 before it flows out of open front 14. Drain hole 20 may be in fluid communication with trench 16. Drain hole 20 may be configured to evacuate any fluid from bottom pan member 12 that flows into trench 16. Trench cover 22 may be configured for providing flat trench surface 24 over trench 16. Trench cover 22 may include perforations 26 to allow fluid to flow into trench 16 from bottom pan member 12 of drain pan 10.

Bottom pan member 12 may be included with drain pan 10. See FIGS. 1-5D. Bottom pan member 12 may be the main component of drain pan 10 for collecting fluid and directing the flued to trench 16 in open front end 14 of bottom pan member 12. In select embodiments of drain pan 10, bottom pan member 12 may include sidewalls 28 around bottom pan member 12 everywhere except open front 14. Sidewalls 28 may be any size or shape of sidewalls or protrusions, humps, hills, or the like for keeping water from leaking out of bottom pan member 12, except through open front 14. Sidewalls 28 may be positioned around the periphery of bottom pan member 12 everywhere except open front 14. As such, sidewalls 28 may be configured to provide barrier 30 to fluids from escaping bottom pan member 12 of drain pan 10. Whereby, as sidewalls 28 are raised or higher than open front 14, sidewalls 28 may direct any fluid on bottom pan member 12 to trench 16 via gravity. In select embodiments, sidewalls 28 of bottom pan member 12 may include left sidewall 32 on left side 34 of bottom pan member 12, back sidewall 36 on back 38 of bottom pan member 12, and right sidewall 40 on right side 42 of bottom pan member 12. Sidewalls 28 may be connected and sealed together at corner joints 58 and to bottom pan member 12 via connecting method 60. Connecting method 60 may include, but is not limited to, integral forming, welding, adhesives, the like, or any other various means or method for connecting and sealing sidewalls 28 together and to bottom pan member 12 to create barrier 30. In select embodiments, sidewalls 28 may have ends 56 that extend beyond trench 16. These ends 56 may taper where they extend beyond trench 16 approximate open front 14 of bottom pan member 12. These tapers of ends 56 may be configured for safety (eliminating raised sharp edge) and/or aesthetic appearance. These tapers of ends 56 may also be configured to accommodate for open front 14 of drain pan 10 allowing for easy loading of equipment into drain pan 10.

Bottom pan member 12 may include shape and configuration 44 configured to fit under and hold piece of equipment 46. Bottom pan member 12 may include any shape and configuration 44 for any desired piece of equipment 46. In select embodiments, bottom pan member 12 may include shape and configuration 44 configured to fit under appliance 48 including, but not limited to, washing machine 50, as shown in the Figures. However, the disclosure is not so limited, and bottom pan member 12 may be shaped and configured to fit under any desired appliance 48, including, but not limited to, a refrigerator, an air conditioner, a dishwasher, a hot water heater, an icemaker, the like, or other various pieces of residential, commercial, or industrial equipment or appliances. As shown in the Figures, in select embodiments, shape 44 of bottom pan member 12 may be rectangular shape 52 or square shape 54.

Bottom pan member 12 may have smooth flat top 62. See FIGS. 1-5D. Smooth flat top 62 of bottom pan member 12 may be configured to allow fluid to flow undisturbed on top of and across bottom pan member 12 into trench 16 at open front 14 of bottom pan member 12.

Trench cover 22 may be included with drain pan 10. See FIGS. 1-5D. Trench cover 22 may be for covering trench 16 and providing a flat surface over trench 16 while allowing fluid to flow into trench 16 via its perforations 26 therethrough, or the like. Perforations 26 may be visible in select embodiments or may be positioned where they are not visible in other embodiments, like on the sides or under the appliance. As such, trench cover 22 may be configured to hide trench 16 from view and allow fluid to empty into trench 16. In select embodiments, trench cover 22 may be configured as decorative cover 64, which may include various materials, shapes, designs and configurations of perforations 26 therethrough.

Drain fittings 66 may be included with drain pan 10. See FIGS. 1-5A. Drain fittings 66 may be for connecting drain hole 20 in trench 16 with existing drain piping system 68, or the like. Drain fittings 66 may include any pipes, connections, or the like for connecting drain hole 20 with existing drain piping system 68. Drain fittings 66 may thus be configured to connect drain hole 20 in the bottom of trench 16 to existing drain piping system 68, or the like. As examples, and clearly not limited thereto, drain fittings 66 may be adhered, pressed or welded in a watertight manner to the underside of trench 16 and extend below trench 16 to allow for coupling of drain pan 10 to existing drain piping 68.

Referring now to FIGS. 4A-5D, bottom pan member 12 may be configured to be installed at or on floor level 70 or below floor level 70, if desired. As a result, the trench 16 may be configured to be positioned below bottom pan member 12 for catching fluid leaked onto bottom pan member 12 before it reaches floor level 70.

Trench 16 may be included with drain pan 10. Trench 16 may be configured for catching fluid as it enters open front 14 of bottom pan member 12. Trench 16 may thus be connected to open front 14 of bottom pan member 12 by connection means 72. Connection means 72 may be or include any means, devices, mechanisms, or the like, for connecting trench 16 to bottom pan member 12 under open front 14, including, but not limited to, being integrally formed, welded, overlapping, sealed to open front 14 of bottom pan member 12, the like, or any other various means for connecting trench 16 to open front 14 of bottom pan member 12.

Another feature of the disclosed drain pan 10 may be that bottom pan member 12 may include smoothed front lip 74. See FIGS. 1-5D. Smoothed front lip 74 may be configured for safety and to provide support at floor level 70 for trench 16 at open front 14 of bottom pan member 12. Smoothed front lip 74 may be hemmed, rolled or in other ways smoothed for safety and for providing support at floor level 70 for trench 16, where smoothed front lip 74 may initiate open front 14 of drain pan 10.

In select embodiments of the disclosed drain pan 10, bottom pan member 12 may be made from material 76.

Material 76 of bottom pan member 12 may be any desired material including, but not limited to, metals, plastics, rubber, the like, and/or combinations thereof. In select embodiments of the disclosed drain pan 10, trench 16 may be, but does not have to be, made of different material 78 from bottom pan member 12. As exampled, and clearly not limited thereto, trench 16 may be made from metals, plastics, rubbers, the like, and/or combinations thereof.

Another feature of the disclosed drain pan 10 may be that it can be configured to be used with all types of residential appliances or industrial equipment for preventing spills and damage from leaking fluids while being easy to load. Whereby, open front 14 and use of trench 16 is configured to allow for loading of the residential appliances or the industrial equipment in drain pan 10 without obstruction from sidewalls and the functionality to capture leaking fluids, divert the fluids to drain piping and evacuate the leaking fluid without damage to surrounding building materials.

Figure 5A:
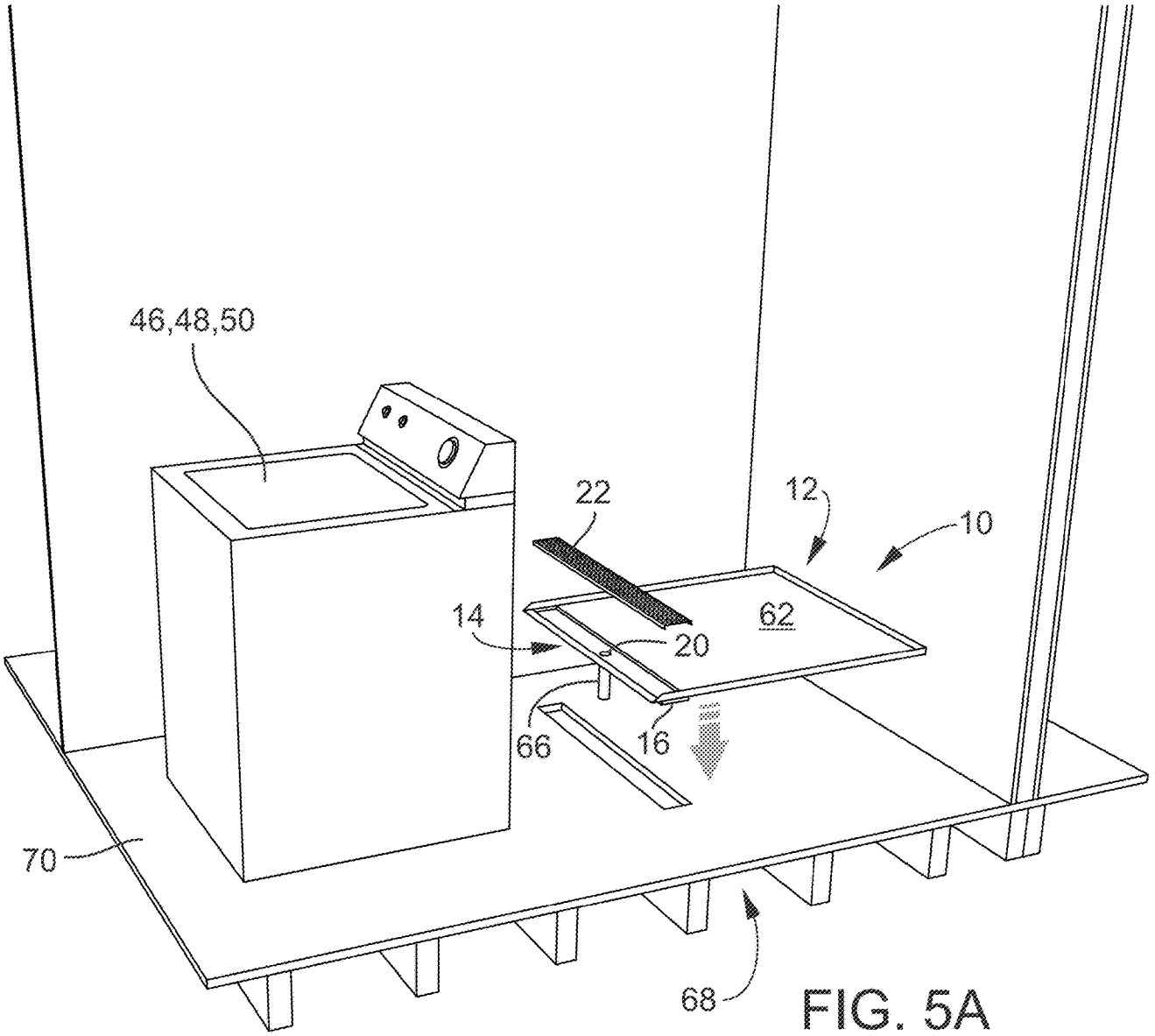
FIG. 5A is a front perspective environmental view of the disclosed drain pan utilizing an open front and a trench according to select embodiments of the instant disclosure being installed in position prior to a washing machine being installed on top of it.
Figure 5B:
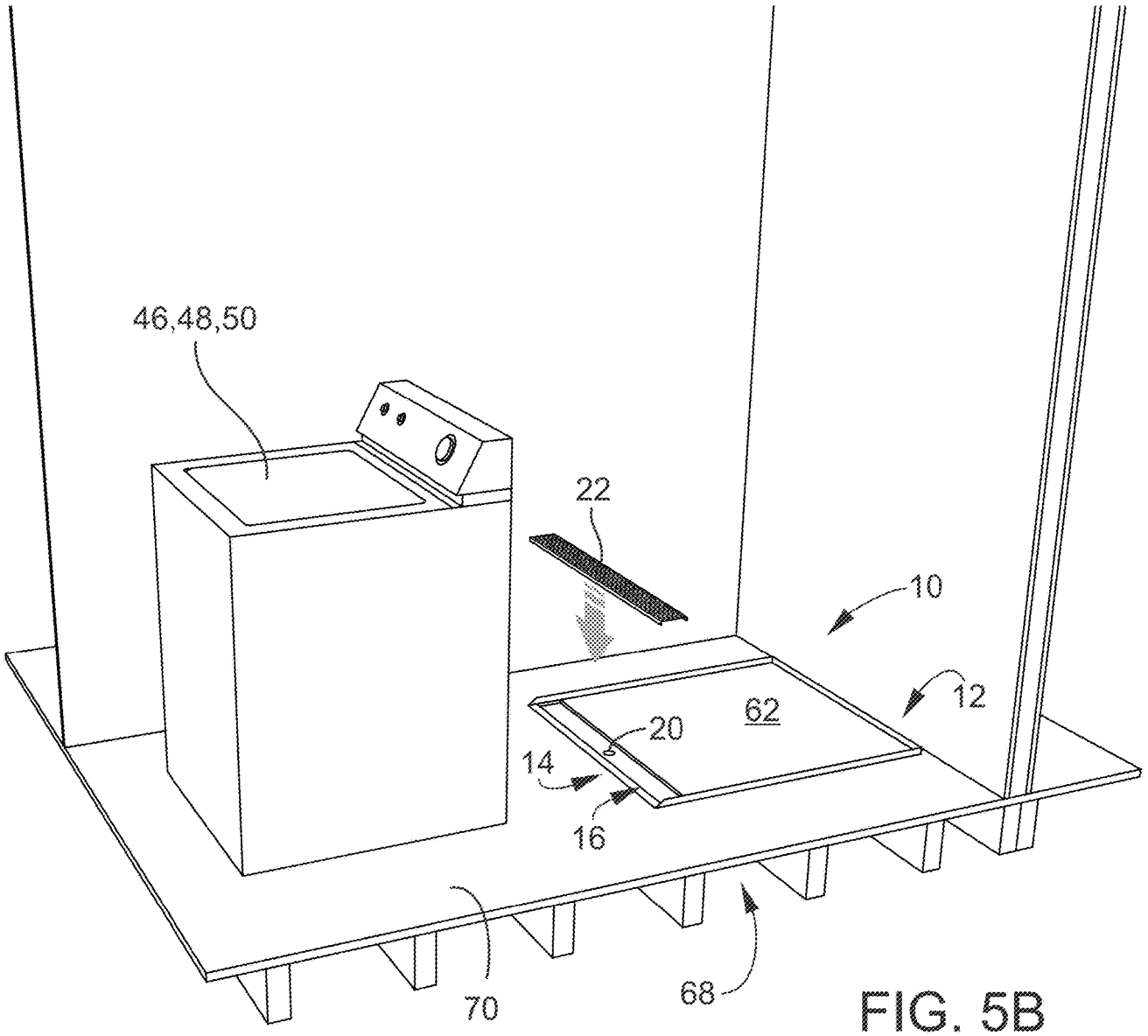
FIG. 5B is another front perspective environmental view of the drain pan utilizing an open front and a trench of FIG. 5A being installed in position prior to a washing machine being installed on top of it with the trench cover ready to be installed over the trench.
Figure 5C:
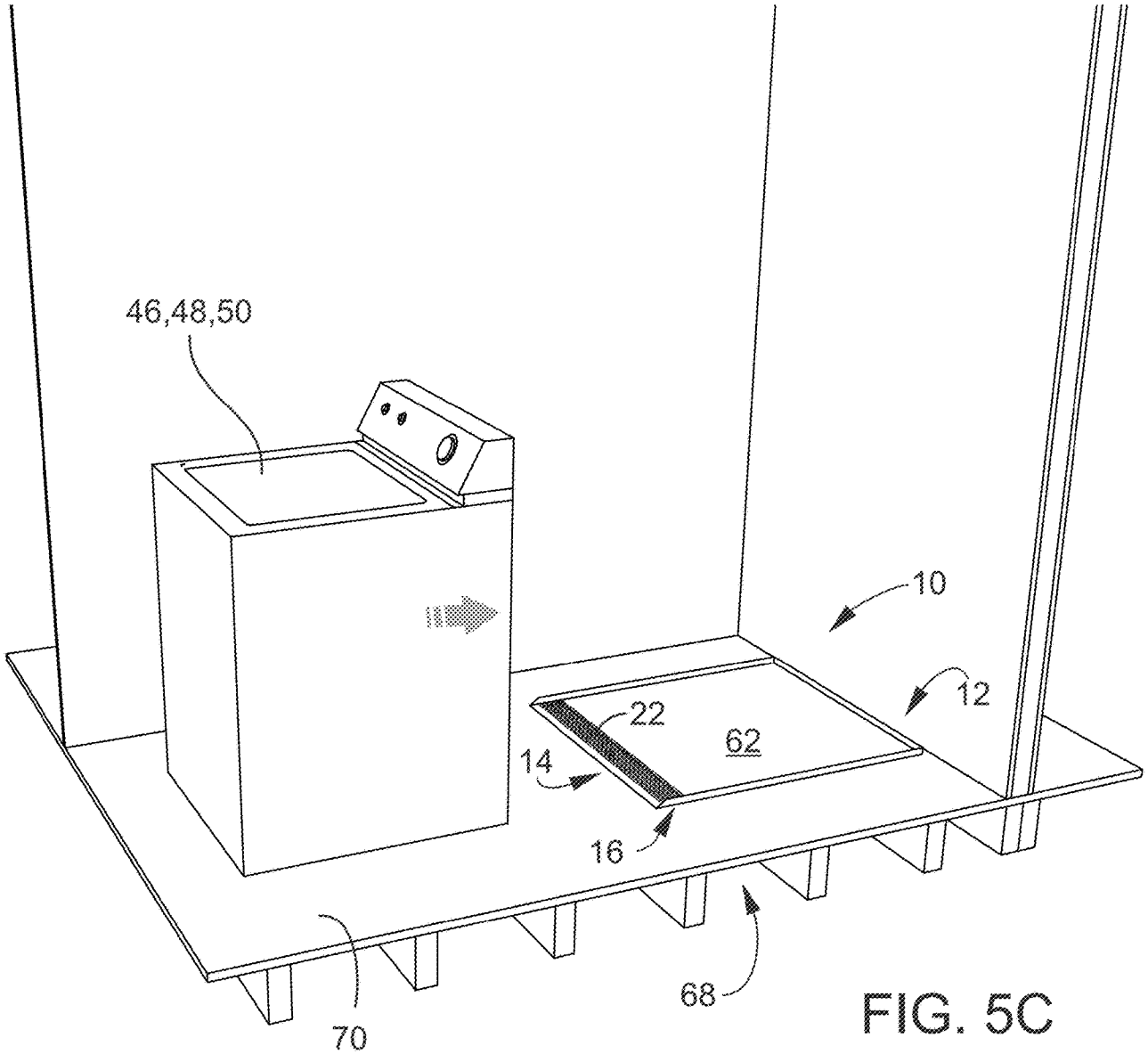
FIG. 5C is another front perspective environmental view of the drain pan utilizing an open front and a trench of FIG. 5A being installed in position prior to a washing machine being installed on top of it with the trench cover in place and ready for the washing machine to be slid on top of the drain pan.
Figure 5D:
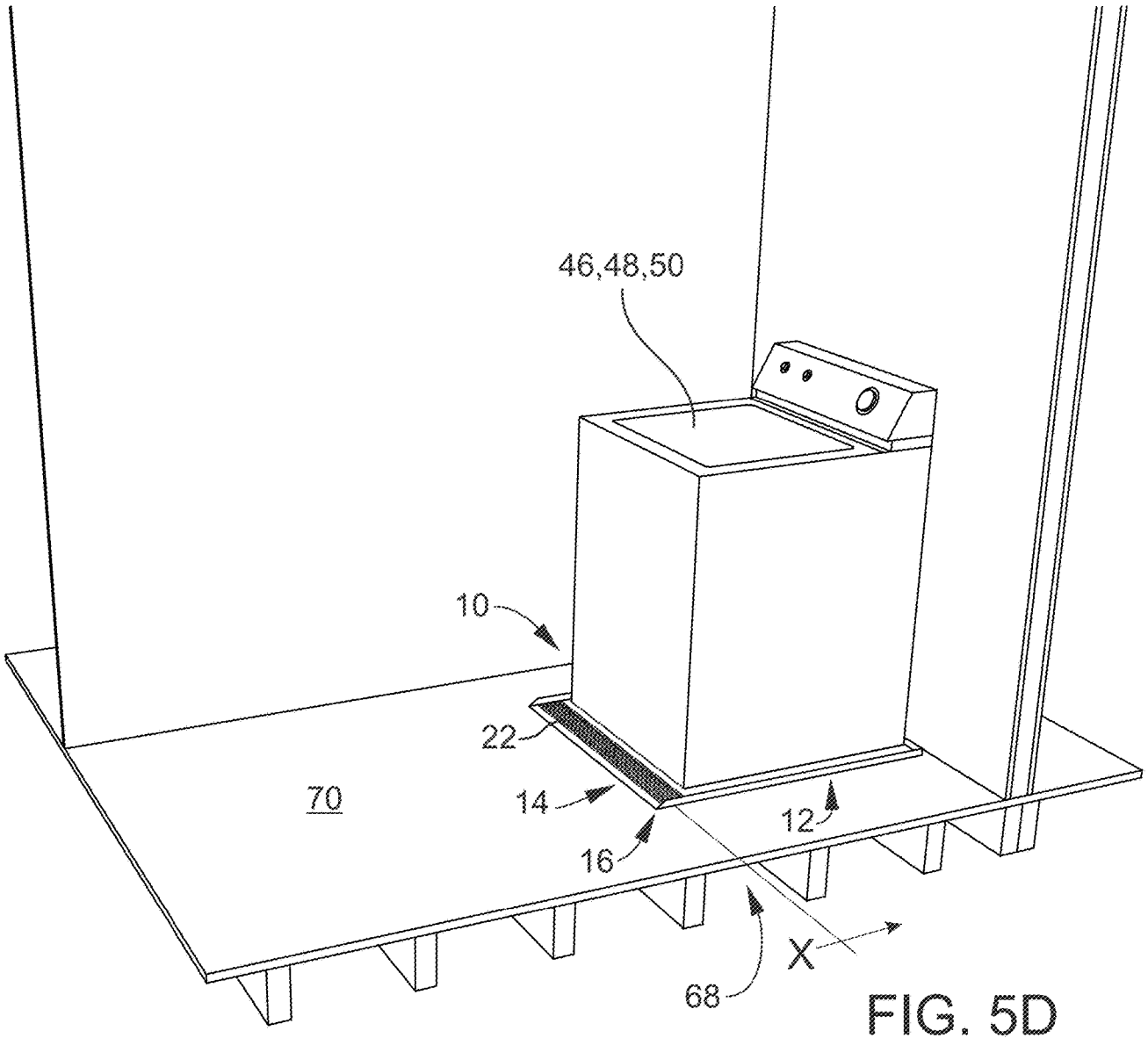
FIG. 5D is another front perspective environmental view of the drain pan utilizing an open front and a trench of FIG. 5A installed in position with the washing machine installed on top of it by sliding the washing machine through the open front of the drain pan.
Figure 6:
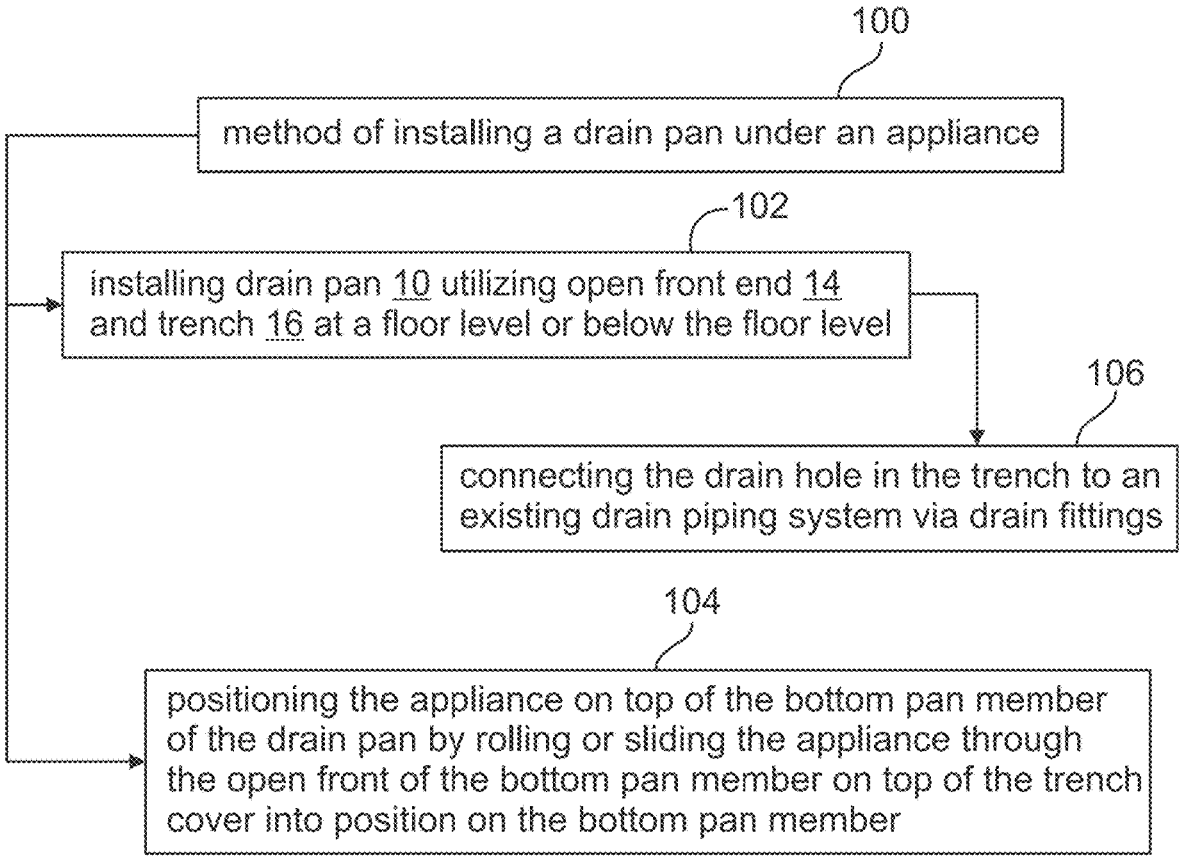
FIG. 6 is a flow chart of a method of installing a drain pan under an appliance according to select embodiments of the instant disclosure.

Referring now specifically to FIG. 6, in another aspect, the instant disclosure embraces method 100 of installing drain pan 10 under appliance 48 (or any other piece of equipment), including, but not limited to, like under washing machine 50, as shown in FIGS. 4A-5D. Method 100 of installing drain pan 10 under appliance 48 generally may include utilizing drain pan 10 utilizing open front 14 and trench 16 in any of the various embodiments and/or combinations of embodiments shown and/or described herein. As such, method 100 of installing drain pan 10 under appliance 48 may generally include step 102 of providing drain pan 10 utilizing open front 14 and trench 16 in any of the various embodiments and/or combinations of embodiments shown and/or described herein, as shown in FIGS. 5A-5C. With the provided drain pan 10 utilizing open front 14 and trench 16 installed, method 100 may further include step 104 of positioning appliance 48 on top of bottom pan member 12 of drain pan 10 by rolling or sliding appliance 48 (or any other piece of equipment) through open front 14 of bottom pan member 12 on top of trench cover 22 into position on bottom pan member 12, as best shown in FIGS. 5C-5D. In select embodiments, method 100 of installing drain pan 10 under appliance 48 may further include step 106 of connecting drain hole 20 in trench 16 to existing drain piping system 68 via drain fittings 66.

In sum, the disclosed drain pan 10 design can be used with all types of residential appliances and industrial equipment for preventing spills and damage from leaking fluids while being easy to load. The open front 14 and use of trench 16 on drain pan 10 may allow for loading of equipment in pan without obstruction from sidewalls and the functionality to capture leaking fluids, divert the fluids to drain piping and evacuate the fluid without damage to surrounding building materials. Drain pan may be installed at floor or below the finished floor level 70. Existing drain pipe system 68 may be fixed to drain fitting 66 welded at bottom of trench 16. Trench cover 22 may be placed in trench 16 and the appliance or equipment wheeled into the pan without worrying about impediment of a sidewall. Any leaking that may occur from an appliance or piece of equipment held within the pan area would be captured and directed to flow into trench 16 and out drain fitting 66 into drain piping system 68.

A feature of the present disclosure may be its ability to allow for loading of appliance or equipment into a containment pan system through an open front configuration with no impediment of wall or need to fix a wall to the open side of the system after loading while at the same time providing constant and continual spill containment via enclosing sidewalls 28, trench 16 and drain fitting portions of the system.

Another feature of the present disclosure may be its ability to provide decorative enhancement via trench cover 22 insert that covers trench 16 and draining apparatus of the system while at the same time providing flat trench surface 24 for loading of equipment into the system across the depressed trench area of the system.

Another feature of the present disclosure may be its ability to use in combination spill containment (drain pan) and fluid management (trench) methods, traditionally used separately, through a component assembly acting as a single containment and draining system.

The bottom pan member 12 of the drain pan may be the flat surface of the system positioned behind trench 16 on one side and enclosed on the three other sides by sidewalls 28 angled up and fully sealed at corners via weld, sealant material, forming methods or other manners of sealing to provide spill coverage under appliance or equipment held within drain pan 10. Captured leaking fluid will be directed to trench 16 of the system and then to access the drain fitting 66 positioned to the bottom of trench 16 of the system. Drain pan 10 may be made of different materials such as metals, plastics, rubber and other materials commonly used in container construction.

Trench 16 may be the depressed area of the system which is adjacent to the bottom pan member 12 and positioned below the pan area so that fluid flowing out of the pan area will be captured in trench 16 and directed to drain hole 20 to be evacuated from the system. Trench 16 can be connected to the pan area via forming, welding, adhesive, pressed fitted or overlapping flanges and other manners for connection between to pieces of an assembly system. Trench 16 may be made of different materials such as metals, plastics, rubber and other materials commonly used in container construction.

Drain fitting 66 may extends below trench 16 of the system and begins at drain hole 20 in the bottom of trench 16 and terminates at a point below floor level to allow for coupling of trench 16 to an existing drain pipe system 68 for evacuation of leaking fluids. Drain fitting 66 may be connected to trench 16 using various methods of connection including forming, welding, adhesive, pressed fitting and other forms of connection. Drain fitting 66 may be made of different materials such as metals, plastics, rubber and other materials commonly used in drain piping and fitting construction.

Trench cover 22 may provides a decorative cover that 1) covers trench 16 depression of the system to provide flat trench surface 24 throughout the visible pan area, 2) hide trench 16 area of drain pan 10 from view and 3) allows leaking fluid to empty into trench 16 of drain pan 10. Trench cover 22 insert will have perforations 26 which give a visible appearance of covering the trench area while at the same time allowing fluids to flow through perforations 26 into trench 16 to drain hole 20. Perforations 26 in trench cover 22 insert may be visible or may be positioned in the none visible area of the cover at the sides or bottom of the cover inside trench 16. Trench cover 22 insert may be made of different materials such as metals, plastics, rubber and other materials commonly used in cover and insert construction.

Sidewall or walls 28 may be formed or connected to bottom pan member 12 of the system and provide barrier 30 to leaking fluids from escaping drain pan 10, directing any contents to trench 16. Sidewalls 28 may be of different heights and may vary in height from one another. Sidewalls 28 may extend beyond trench 16 area and may taper at ends 56 at open front 14 of the system for safety and aesthetic appearance. Sidewalls 28 may be connected together at corner joints 58 and to bottom pan member 12 using various connecting methods including forming, welding, adhesive and other connection method. Sidewalls 28 may be made of different materials such as metals, plastics, rubber and other materials commonly used in container construction.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. A drain pan comprising:

a bottom pan member including an open front;

a trench positioned below the bottom pan member adjacent the open front of the bottom pan member of the drain pan, where the trench is configured to capture fluid flowing onto the bottom pan member of the drain pan before the fluid flows out of the open front;

a drain hole in communication with the trench, the drain hole is configured to evacuate any of the fluid from the bottom pan member that flows into the trench; and a trench cover configured for providing a flat trench surface over the trench, the trench cover including perforations to allow the fluid to flow into the trench from the bottom pan member of the drain pan.

2. The drain pan of claim 1, wherein the bottom pan member including sidewalls around the bottom pan member everywhere except the open front.

3. The drain pan of claim 2, wherein the sidewalls positioned around the bottom pan member everywhere except the open front are configured to provide a barrier to the fluids from escaping the bottom pan member of the drain pan, whereby the barrier created by the sidewalls direct the fluid to the open front and into the trench via gravity.

4. The drain pan of claim 2, wherein the sidewalls of the bottom pan member including:

a left sidewall on a left side of the bottom pan member;

a back sidewall on a back of the bottom pan member; and a right sidewall on a right side of the bottom pan member.

5. The drain pan of claim 4, wherein the bottom pan member including a shape and configuration configured to fit under and hold a piece of equipment.

6. The drain pan of claim 5, wherein the piece of equipment is an appliance selected from a group consisting of: a washing machine, a refrigerator, an air conditioner, a dishwasher, a hot water heater, and an icemaker.

7. The drain pan of claim 6, wherein the shape of the bottom pan member is a rectangular shape or a square shape.

8. The drain pan of claim 4, wherein:

the sidewalls have ends that extend beyond the trench and taper at said ends that extend beyond the trench approximate the open front of the bottom pan member, wherein the ends that are tapered are configured for safety and aesthetic appearance;

the sidewalls are connected and sealed together at corner joints and to the bottom pan member via a connecting method selected from a group consisting of: integral forming; welding; and adhesives;

or combinations thereof.

9. The drain pan of claim 1, wherein the bottom pan member including a smooth flat top, wherein the smooth flat top of the bottom pan member is configured to allow the fluid to flow undisturbed on top of and across the bottom pan member into the trench at the open front of the bottom pan member.

10. The drain pan of claim 1, wherein the trench cover is configured to hide the trench from view and allow the fluid to empty into the trench, wherein the trench cover is configured as a decorative cover.

11. The drain pan of claim 1 further comprising drain fittings connected to the drain hole in the bottom of the trench, the drain fittings are configured to attach the drain hole to an existing drain piping system.

12. The drain pan of claim 1, wherein:

the bottom pan member is configured to be installed at a floor level or below the floor level; and the trench is configured to be positioned below the bottom pan member.

13. The drain pan of claim 1, wherein the trench is connected to the open front of the bottom pan member by a connection means selected from a group consisting of: integrally formed, welded, overlapping, or sealed to the open front of the bottom pan member.

14. The drain pan of claim 1, wherein the open front of the bottom pan member including a smoothed front lip that is configured for safety and to provide support at a floor level for the trench at the open front of the bottom pan member.

15. The drain pan of claim 1, wherein:

the bottom pan member is made from a material selected from a group consisting of: metals; plastics; rubber; and combinations thereof; and the trench is made of a different material selected from a group consisting of: metals; plastics; rubbers; and combinations thereof.

16. The drain pan of claim 1, whereby the drain pan is configured to be used with all types of residential appliances or industrial equipment for preventing spills and damage from leaking fluids while being easy to load, whereby the open front and use of the trench is configured to allow for loading of the residential appliances or the industrial equipment in the drain pan without obstruction from sidewalls and the functionality to capture the leaking fluids, divert the leaking fluids to drain piping and evacuate the leaking fluid without damage to surrounding building materials.

17. A drain pan comprising:

a bottom pan member including an open front and sidewalls around the bottom pan member everywhere except the open front, wherein the sidewalls positioned around the bottom pan member everywhere except the open front are configured to provide a barrier to fluids from escaping the bottom pan member of the drain pan, whereby the sidewalls direct the fluid to a trench via gravity, the sidewalls of the bottom pan member including:

a left sidewall on a left side of the bottom pan member;

a back sidewall on a back of the bottom pan member; and a right sidewall on a right side of the bottom pan member;

the bottom pan member including a shape and configuration configured to fit under and hold a piece of equipment, wherein the piece of equipment is an appliance selected from a group consisting of: a washing machine, a refrigerator, an air conditioner, a dishwasher, a hot water heater, and an icemaker;

wherein the shape of the bottom pan member is a rectangular shape or a square shape;

the sidewalls have ends that extend beyond the trench and taper at said ends that extend beyond the trench approximate the open front of the bottom pan member, wherein the ends that are tapered are configured for safety and aesthetic appearance; and the sidewalls are connected and sealed together at corner joints and to the bottom pan member via a connecting method selected from a group consisting of: integral forming; welding; and adhesives;

the bottom pan member including a smooth flat top, wherein the smooth flat top of the bottom pan member is configured to allow the fluid to flow undisturbed on top of and across the bottom pan member into the trench at the open front of the bottom pan member;

the open front of the bottom pan member including a smoothed front lip that is configured for safety and to provide support at a floor level for the trench at the open front of the bottom pan member;

the trench positioned below the bottom pan member adjacent the open front of the bottom pan member of the drain pan, where the trench is configured to capture the fluid flowing onto the bottom pan member of the drain pan before the fluid flows out of the open front;

a drain hole in communication with the trench, the drain hole is configured to evacuate any of the fluid from the bottom pan member that flows into the trench;

drain fittings connected to the drain hole in the bottom of the trench, the drain fittings are configured to attach the drain hole to an existing drain piping system; and a trench cover configured for providing a flat trench surface over the trench, the trench cover including perforations to allow the fluid to flow into the trench from the bottom pan member of the drain pan, the trench cover is configured to hide the trench from view and allow the fluid to empty into the trench, wherein the trench cover is configured as a decorative cover, the trench is connected to the open front of the bottom pan member by a connection means selected from a group consisting of: integrally formed, welded, overlapping, or sealed to the open front of the bottom pan member;

wherein:

the bottom pan member is configured to be installed at the floor level or below the floor level; and the trench is configured to be positioned below the bottom pan member whereby the drain pan is configured to be used with all types of residential appliances or industrial equipment for preventing spills and damage from leaking fluids while being easy to load, whereby the open front and use of the trench is configured to allow for loading of the residential appliances or the industrial equipment in the drain pan without obstruction from the sidewalls and the functionality to capture the leaking fluids, divert the leaking fluids to drain piping and evacuate the leaking fluids without damage to surrounding building materials.

18. The drain pan of claim 17, wherein:

the bottom pan member is made from a material selected from a group consisting of: metals; plastics; rubber; and combinations thereof; and the trench is made of a different material selected from a group consisting of: metals; plastics; rubbers; and combinations thereof.

19. A method of installing a drain pan under an appliance comprising:

installing the drain pan at a floor level or a below a floor level, the drain pan including:

a bottom pan member including an open front;

a trench positioned below the bottom pan member adjacent the open front of the bottom pan member of the drain pan, where the trench is configured to capture fluid flowing onto the bottom pan member of the drain pan before the fluid flows out of the open front;

a drain hole in communication with the trench, the drain hole is configured to evacuate any of the fluid from the bottom pan member that flows into the trench; and a trench cover configured for providing a flat trench surface over the trench, the trench cover including perforations to allow the fluid to flow into the trench from the bottom pan member of the drain pan; and positioning the appliance on top of the bottom pan member of the drain pan by rolling or sliding the appliance through the open front of the bottom pan member on top of the trench cover into position on the bottom pan member.

20. The method of installing a drain pan under an appliance of claim 19, wherein installing the drain pan further including connecting the drain hole in the trench to an existing drain piping system via drain fittings.

* * * * *